United States Patent [19]

Anno et al.

[11] Patent Number: 4,702,204

[45] Date of Patent: Oct. 27, 1987

[54] LUBRICATION OIL PASSAGE ARRANGEMENT FOR WATER-COOLED INTERNAL COMBUSTION ENGINES

[75] Inventors: Nobuo Anno; Takeo Arai, both of Saitama, Japan

[73] Assignee: Honda Giken Kogyo Kabuhiki Kaisha, Tokyo, Japan

[21] Appl. No.: 808,161

[22] Filed: Dec. 12, 1985

[30] Foreign Application Priority Data

Dec. 14, 1984 [JP] Japan ..... 59-263891

[51] Int. Cl.[4] ..... F01M 1/00

[52] U.S. Cl. ..... 123/196 AB; 123/196 R; 184/6.5

[58] Field of Search ..... 123/196 AB, 196 R; 184/6.5

[56] References Cited

U.S. PATENT DOCUMENTS 4,108,135 8/1978 Kubis ..... 123/196 R 4,538,565 9/1985 Hidaka et al. ..... 123/196 R

*Primary Examiner*—E. Rollins Cross

*Attorney, Agent, or Firm*—Lyon & Lyon

[57] ABSTRACT

A lubricating oil passage arrangement for a water-cooled internal combustion engine with a cylinder block having a plurality of cylinder bores and a water jacket surrounding the cylinder bores. The cylinder block includes a side wall and a bulging portion projecting laterally outwardly from the side wall for defining a lubricating oil passage adjacent to the water jacket. Lubricating oil flowing through the lubricating oil passage is effectively cooled by the cooling water in the water jacket.

6 Claims, 5 Drawing Figures

LUBRICATION OIL PASSAGE ARRANGEMENT FOR WATER-COOLED INTERNAL COMBUSTION ENGINES

The present invention relates to a lubricating oil passage arrangement for use in a water-cooled internal combus-tion engine for automobiles.

There are various prior art internal combustion engines that include a cylinder block having a lubricating oil passage communicating with an oil pump for forcibly supplying lubricating oil through the lubricating oil passage to various engine components to be lubricated such as those shown in U.S. Pat. Nos. 2,118,283, 3,127,586 and 3,961,614. It also is well known to provide an oil cooler in communication with the lubricating oil passage for cooling the lubricating oil flowinq therethrough.

In recent years engines have been designed to rotate at higher speeds and produce higher power outputs whereby the temperature of the lubricating oil tends to be increased. It is therefore preferable to cool the lubricating oil while it flows through the engine cylinder block for thereby improving the engine performance and reducing the capacity of the oil cooler.

It is an object of the present invention to provide a lubricating oil passage device for water-cooled internal combustion engines which includes a lubricating oil passage defined in the cylinder block adjacent to a water jacket therein for enabling the cooling water in the water jacket to cool the lubricating oil flowing through the lubricating oil passage.

According to the present invention, a lubricating oil passage device for a water-cooled internal combustion engine includes a cylinder block having a plurality of cylinder bores and a water jacket surrounding the cylinder bores, the cylinder block including a side wall with a bulging portion projecting laterally outwardly from the side wall and defining a lubricating oil passage adjacent to the water jacket. The lubricating oil passage comprises a first passage extending parallel to the axis of one of the cylinder bores, a second passage extending parallel to the crankshaft rotatably supported in the cylinder block, and a third passage communicating between the first and second passages, with the first passage being disposed adjacent to one side of the water jacket and the second and third passages being disposed closely to the bottom of the water jacket. Lubricating oil flowing through the lubricating oil passages is effectively cooled by the cooling water in the water jacket.

The above and other objects, features and advantages of the present invention will become more apparent from the following description when taken in conjunction with the accompanying drawings in which a preferred embodiment of the present invention is shown by way of illustrative example.

Figure 1:
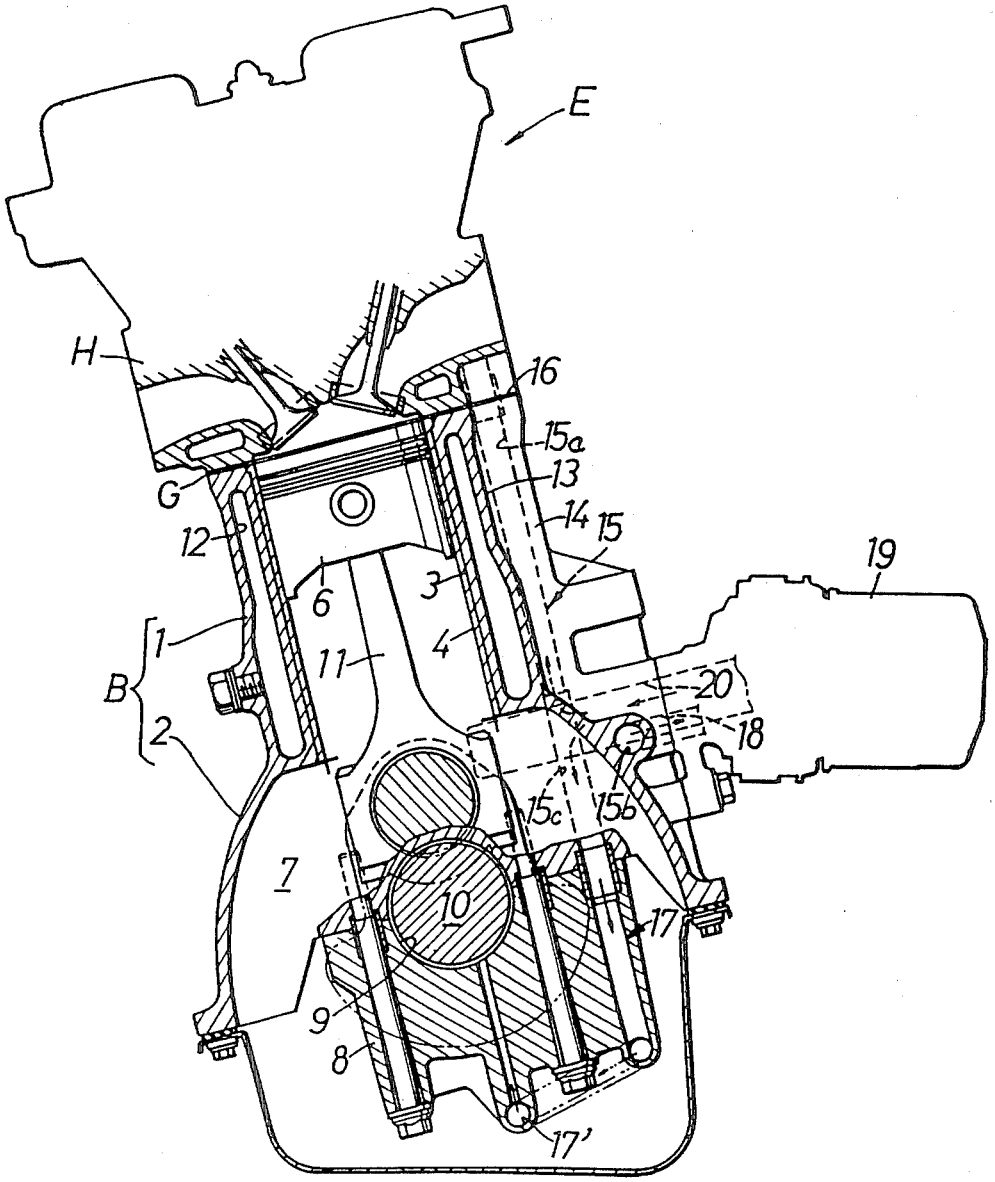
FIG. 1 is a vertical cross-sectional view of an internal combustion engine incorporating the lubricating oil passage arrangement of the present invention.

The present invention is shown in the drawings incorporated in an in-line four-cylinder water-cooled internal combustion engine but it will readily appear to those skilled in the art that the engine may have more or fewer cylinders and in a different cylinder arrangement. The engine E has a cylinder block B and a cylinder head H mounted thereon with a gasket G interposed between the cylinder block B and the cylinder head H.

The cylinder block B preferably is integrally cast of an aluminum alloy by the casting process disclosed in U.S. Pat. Nos. 4,436,140 and 4,519,436. The cylinder block B generally comprises an upper cylinder-defining portion 1 and a lower crankcase-defining portion 2. The cylinder defining portion 1 has four in-line cylinder bores 3 defined therein in the so-called Siamese configuration with no water jackets in the boundary walls 5 between adjacent cylinder bores 3. A tubular cylinder liner 4 is fitted in each of the cylinder bores 3, and a piston 6 is slidably fitted in the tubular cylinder liner 4.

The lower crankcase-defining portion 2 of the cylinder block B has a plurality of integral cast journal walls 7 spaced at intervals along the direction in which the cylinder bores 3 are arranged in line. A bearing cap 8 is fixed to the lower surface of each of the journal walls 7. A crankshaft 10 is rotatably supported in bearing holes 9 defined between the journal walls 7 and the bearing caps 8. The crankshaft 10 is operatively connected to the pistons 6 by connecting rods 11.

The cylinder-defining portion 1 also has a water jacket 12 defined in surrounding relation to the cylinder bores 3. The water jacket 12 extends substantially the full length of each of the cylinder bores 3.

Figure 2:
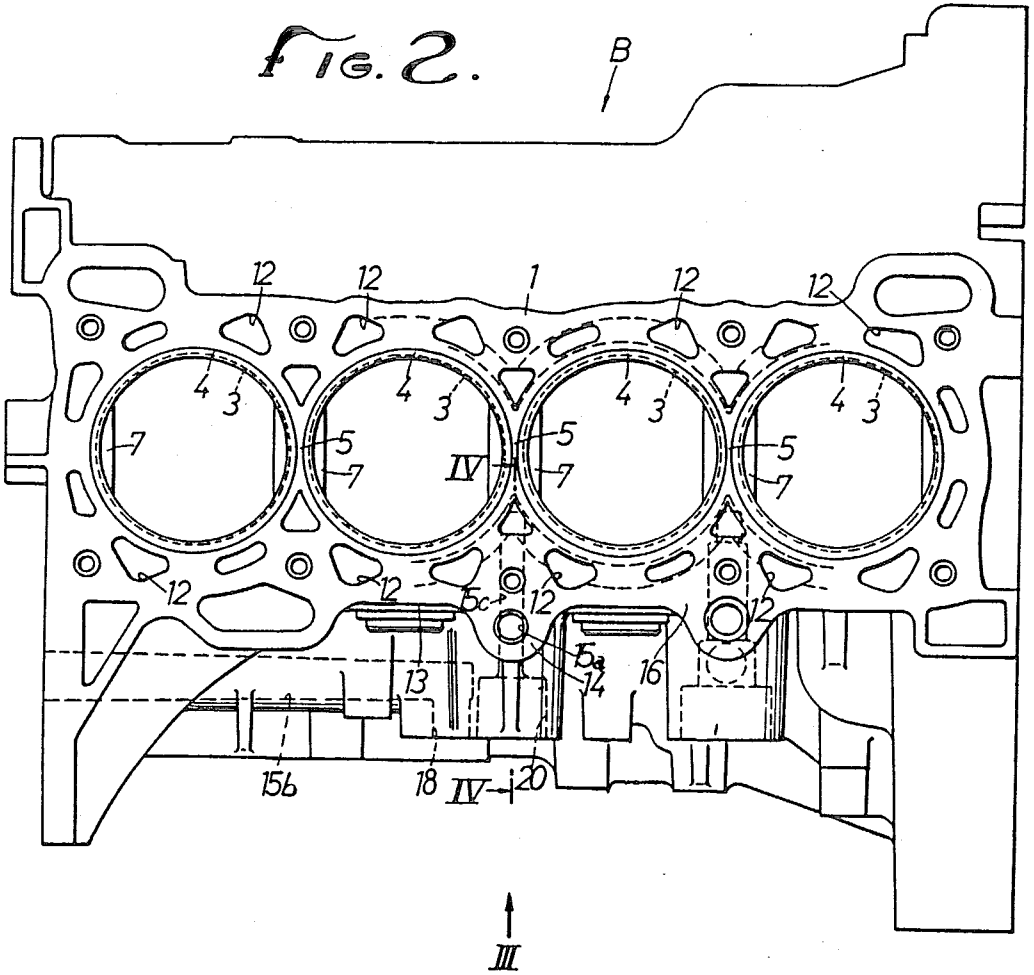
FIG. 2 is a top plan view of the cylinder block of the internal combustion engine shown in FIG. 1.
Figure 3:
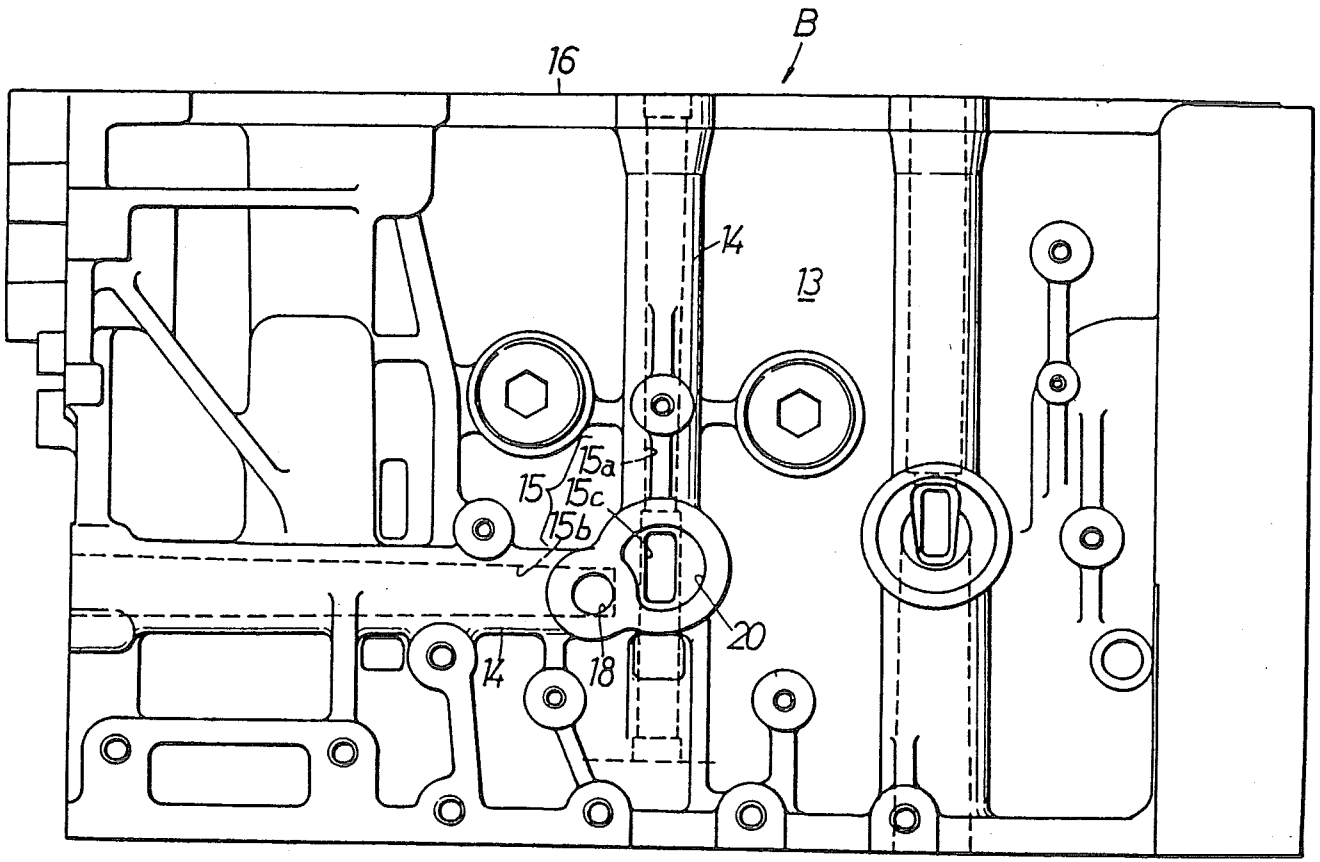
FIG. 3 is a side elevational of the cylinder block as seen in the direction of the arrow III in FIG. 2.
Figure 4:
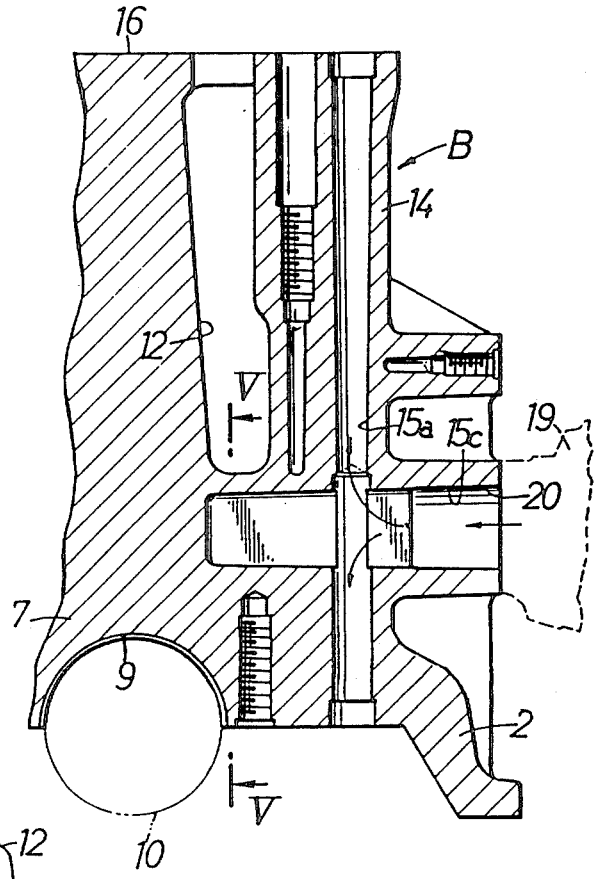
FIG. 4 is an enlarged cross-sectional view taken substantially along line IV—IV of FIG. 2.
Figure 5:
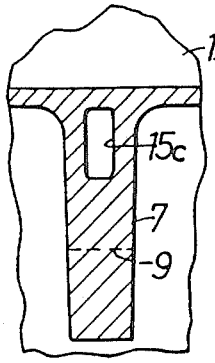
FIG. 5 is a cross-sectional view taken substan-tially along line V—V of FIG. 4.

As illustrated in FIGS. 2 through 4, a bulging portion 14 of a substantially T shape projects laterally outwardly from the outer surface of one side wall 13 of the cylinder block B. The bulging portion 14 has a lubricating oil passage 15 formed therein such as by a core used in casting the cylinder block B. The lubricating oil passage 15 comprises a first passage **15*a* extending vertically parallel to the central axis of one of the cylinder bores 3, a second passage 15*b* extending substantially horizontally parallel to the crankshaft 10, and a third passage 15*c* extending substantially horizontally in a direction normal to the crankshaft 10 and interconnecting the first and second passages 15*a* and 15*b* through an oil filter 19. The first passage 15*a* extends substantially parallel to the water jacket 12 and adjacent to one side of the water jacket 12. The first passage 15*a* has an upper end opening at the top deck 16 of the cylinder block B for communicating with a lubricating oil system (not shown) defined in the cylinder head H. The first passage 15*a* has a lower portion extending through one of the journal walls 7 and opening at the lower surface of that journal wall 7 for communicating with an oil passage 17 defined in the corresponding bearing cap 8. The oil passage 17 includes a main gallery 17' for supplying lubricating oil to components to be lubricated. The second passage 15*b* extends along the direction in which the cylinder bores 3 are arranged in line and is positioned to the bottom of the water jacket 12. The second passage 15*b* has an outer end opening at an end surface of the cylinder block B for communicating with an oil pump (not shown). An outlet port 18 communicates with the second passage 15*b* near its inner end and also with the inlet of the oil filter 19 which is mounted on the side wall 13 of the cylinder block B. The third passage 15*c* extends from the bulging portion 14 toward the journal wall 7 in a substantially horizontal direction normal to the crankshaft 10. The third passage 15***c* has a closed inner end located beneath the water jacket 12 (FIGS. 4 and 5) and an outer end communicating with an inlet port 20 defined in the side wall 13 of the cylinder block B. The inlet port 20 is connected to the outlet of the oil filter 19.

When the engine is operated, lubricating oil supplied under pressure from the oil pump flows through the second passage 15*b* into the oil filter 19. After the lubricating oil has been filtered by the oil filter 19, it flows into the third passage 15*c* and then flows upwardly and downwardly through the third passage 15*a* into the lubricating oil system in the cylinder head H and the oil passage 17 in the bearing cap 8 for thereby lubricating the various engine parts.

The lubricating oil flowing through the first, second and third passages 15*a*, 15*b* and 15*c* is effectively cooled by the cooling water flowing through the water jacket 12 since all or part of the first, second and third passages 15*a* , 15*b* and 15*c* is located adjacent to the water jacket 12. Therefore, the engine performance is improved and the capacity of the oil filter 19 can be reduced.

In the event the cylinder block B is cast of an aluminum alloy by the casting process referred to above, the molten aluminum alloy cools rapidly and solidifies in a short period of time, and therefore it is preferable not to form thick walls and solid blocks which would require a large amount of molten metal which may result in casting defects such as cavities. Since the third passage 15*c* can be formed in the casting process by using a core in the journal wall 7 which would otherwise require a relatively large amount of molten metal to be poured thereby causing casting defects therein, the journal wall 7 can be cast which is free from such casting defects.

Although a certain preferred embodiment has been shown and described, it should be understood that many changes and modifications may be made therein without departing from the scope of the appended claims.

What is claimed:

1. A lubricating oil passage arrangement for a water-cooled internal combustion engine including a cylinder block having a side wall, a plurality of cylinder bores in said cylinder block, a water jacket surrounding said cylinder bores, and a crankshaft rotatably supported in said cylinder block, said lubricating oil passage arrangement comprising:

a portion of said cylinder block side wall adjacent said water jacket bulging laterally outwardly therefrom, a first passage within said side wall portion extending substantially parallel to an axis of one of said cylinder bores adjacent one side of said water jacket, a second passage extending substantially parallel to said crankshaft and a third passage communicating between said first and second passages, and said second and third passages beng disposed closely subjacent said water jacket.

2. A lubricating oil passage arrangement according to claim 1 including an oil filter connected between said second and third passages.

3. In an internal combustion engine including walls defining a cylinder block having a plurality of cylinder bores, a water jacket surrounding said cylinder bores and a lubricating arrangement including passages for circulating lubricating oil under pressure through an oil filter and thence to a lubricating system for conducting said filtered lubricant to components of said engine to be lubricated, means in said lubricating arrangement for cooling said circulating lubricant, said means comprising:

a portion of at least one of said walls parallel to the axes of said bores bulging laterally outwardly from the remainder of said wall, one of said passages in said lubricating arrangement extending through said portion in close proximity to said water jacket, and the other of said passages in said lubricating arrangement communicating with said one passage and extending through said walls closely subjacent said water jacket.

4. Apparatus according to claim 3 in which at least one of said other passages is a substantially horizontal passage extending along the bottom of said water jacket.

5. Apparatus according to claim 4 including means connecting one of said horizontal passages to the inlet of said oil filter and said one passage connecting with the outlet thereof.

6. Apparatus according to claim 5 in which said cylinder block includes a plurality of spaced journal walls, and another of said horizontally extending passages extends between said one passage and one of said journal walls.

* * * * *